US009548547B2

(12) United States Patent
Wu et al.

(10) Patent No.: US 9,548,547 B2
(45) Date of Patent: Jan. 17, 2017

(54) SWITCH WIRE-CONNECTION TERMINAL BLOCK STRUCTURE

(71) Applicants: SWITCHLAB INC., New Taipei (TW); SWITCHLAB (SHANGHAI) CO., LTD., Shanghai (CN)

(72) Inventors: Chih-Yuan Wu, New Taipei (TW); Chih-Kun Hsiao, New Taipei (TW); Wen-Bing Hsu, New Taipei (TW)

(73) Assignees: Switchlab Inc., New Taipei (TW); Switchlab (Shanghai) Co., Ltd., Shanghai (CN)

( * ) Notice: Subject to any disclaimer, the term of this patent is extended or adjusted under 35 U.S.C. 154(b) by 0 days.

(21) Appl. No.: 14/685,776

(22) Filed: Apr. 14, 2015

(65) Prior Publication Data

US 2015/0303595 A1 Oct. 22, 2015

(30) Foreign Application Priority Data

Apr. 16, 2014 (TW) ..... 103206602 U

(51) Int. Cl.

| | |
|---|---|
| ***H01R 4/30*** | (2006.01) |
| ***H01R 9/24*** | (2006.01) |
| ***H01H 71/08*** | (2006.01) |
| *H01R 4/48* | (2006.01) |

(52) U.S. Cl.

CPC ..... *H01R 9/2416* (2013.01); *H01H 71/08* (2013.01); *H01R 4/4863* (2013.01)

(58) Field of Classification Search

CPC ..... H01R 13/514; H01R 9/24; H01R 4/38; H01R 13/207; H01R 13/621; H01R 4/2475

USPC ..... 439/709, 727, 801, 810, 814

See application file for complete search history.

(56) References Cited

U.S. PATENT DOCUMENTS

| | | | | |
|---|---|---|---|---|
| 3,555,215 | A * | 1/1971 | Dehn | H01H 21/285 200/280 |
| 4,832,628 | A * | 5/1989 | Huska | H01R 4/38 439/716 |
| 5,030,139 | A * | 7/1991 | Huska | H01R 4/38 439/513 |
| 6,188,560 | B1 * | 2/2001 | Waas | H01R 4/2408 361/119 |
| 6,293,830 | B1 * | 9/2001 | Park | H01R 9/26 439/709 |
| 6,897,584 | B2 * | 5/2005 | Doherty | H02K 5/225 310/71 |

(Continued)

*Primary Examiner* — Abdullah Riyami
*Assistant Examiner* — Thang Nguyen
(74) *Attorney, Agent, or Firm* — Rosenberg, Klein & Lee

(57) ABSTRACT

A switch wire-connection terminal block structure includes a casing and at least one contact terminal. The contact terminal has a locking hole in direct communication with a receiving hole. The receiving hole communicates with a wire socket. A locking member is disposed in the receiving hole and lockable in the locking hole. A gasket member is fitted on the locking member. A guide channel is formed on inner wall of the receiving hole and extends in a locking direction of the locking member. The gasket member has a guide section extending in a direction reverse to the locking direction of the locking member. The guide section is slidably disposed in the guide channel. The receiving hole provides a larger locking travel for the locking member so that the terminal block is applicable to closed wire terminal.

16 Claims, 7 Drawing Sheets

(56) References Cited

U.S. PATENT DOCUMENTS

| | | | | |
|---|---|---|---|---|
| 6,916,213 | B2 * | 7/2005 | Nyblin | H01R 4/304 439/709 |
| 8,192,238 | B2 * | 6/2012 | Majewski | H01R 4/44 439/801 |
| 9,083,093 | B2 * | 7/2015 | Diessel | H01R 4/302 |
| 9,308,877 | B2 * | 4/2016 | Shiba | B60L 11/123 |
| 2008/0280502 | A1 * | 11/2008 | Guethoff | H01R 9/2491 439/709 |

* cited by examiner

SWITCH WIRE-CONNECTION TERMINAL BLOCK STRUCTURE

BACKGROUND OF THE INVENTION

1. Field of the Invention

The present invention relates generally to a switch wire-connection terminal block structure, and more particularly to an improved locking structure of a terminal block for locking wire terminal. In the condition that the volume of the terminal block is not increased, the terminal block has a full gap between the locking member and the locking hole. Therefore, the terminal block is applicable to closed wire terminals to facilitate the connection between wires.

2. Description of the Related Art

A switch wire-connection terminal block is a power switch member with contact terminals. The switch wire-connection terminal block is applied to circuit system in electronic and electrical engineering field. The switch wire-connection terminal block is mainly mounted on inner face of the operation panel or distribution box panel of electronic and electrical equipment to connect the wiring circuits thereof. The switch wire-connection terminal block has a pushbutton protruding from the surface of the operation panel or distribution box panel. The switch wire-connection terminal block can be further connected to the switch wire-connection terminal block of other wiring circuits in the electronic and electrical equipment for an operator to press the pushbutton so as to operate and control powering on/off of the respective wiring circuits. Accordingly, the switch wire-connection terminal block is used to power on/off the circuits.

Please refer to FIG. 1, which is a sectional view of a conventional switch wire-connection terminal block. The conventional switch wire-connection terminal block has a casing 1*a* and a pushbutton 2*a* movably disposed at front end of the casing 1*a*. The pushbutton 2*a* extends into the casing 1*a* to bear the elastic force of a spring 21*a*. A first contact terminal 41*a* and a second contact terminal 42*a* are disposed in the casing 1*a* on two sides of the pushbutton 2*a*. An electro-conductive member 3*a* is also disposed in the casing 1*a* and positioned between the first and second contact terminals 41*a*, 42*a*. The electro-conductive member 3*a* is connected with the pushbutton 2*a*. Two ends of the first and second contact terminals 41*a*, 42*a* are respectively formed with a locking hole 411*a*, 421*a* and a contact section 412*a*, 422*a* corresponding to the electro-conductive member 3*a*. By means of pressing the pushbutton 2*a*, the electro-conductive member 3*a* is driven by the pushbutton 2*a* to contact or separate from the contact sections 412*a*, 422*a* of the first and second contact terminals 41*a*, 42*a* so as to power on or power off the first and second contact terminals 41*a*, 42*a*.

In addition, the rear end of the casing 1*a* is formed with two receiving holes 15*a*, 16*a* respectively in communication with the locking holes 411*a*, 421*a* of the first and second contact terminals 41*a*, 42*a*. Two lateral ends of the casing 1*a* are further respectively formed with two wire sockets 17*a*, 18*a*. The wire sockets 17*a*, 18*a* respectively intersect and communicate with the receiving holes 15*a*, 16*a*. Moreover, a screw 51*a*, 52*a* is disposed in each receiving hole 15*a*, 16*a* for locking into the locking hole 411*a*, 421*a*. In use, the screws 51*a*, 52*a* are first framed by external wire terminals and then the screws 51*a*, 52*a* are locked into the locking holes 411*a*, 421*a* of the first and second contact terminals 41*a*, 42*a* to electrically connect with the first and second contact terminals 41*a*, 42*a*.

However, in order to commonly frame the screws 51*a*, 52*a* with various external wire terminals 91*a*, 92*a* (including open and closed wire terminals), a full gap H must be reserved between the tail ends of the screws 51*a*, 52*a* and the locking holes 411*a*, 421*a* in an unlocked state. Only in this case, various external wire terminals 91*a*, 92*a*, including closed wire terminals can extend into the casing 1*a* to frame the screws 51*a*, 52*a*.

As aforesaid, the receiving holes 15*a*, 16*a* intersect and communicate with the wire sockets 17*a*, 18*a*. Therefore, after the screws 51, 52*a* are unscrewed and loosened from the locking holes 411*a*, 421*a*, the screws 51*a*, 52*a* tend to tilt down toward the wire sockets 17*a*, 18*a*. Under such circumstance, the locking ends of the screws 51*a*, 52*a* are displaced from the positions in alignment with the locking holes 411*a*, 421*a*. As a result, when it is desired to screw the screws 51*a*, 52*a* back into the locking holes 411*a*, 421*a*, it is hard to aim the screws 51*a*, 52*a* at the locking holes 411*a*, 421*a* and screw the screws 51*a*, 52*a* into the locking holes 411*a*, 421*a*. This is quite troublesome to an operator.

To solve the above problem, an improved switch wire-connection terminal block employs a design of a correction gasket member 61*a*, 62*a*, which is fitted on each of the screw 51*a*, 52*a*. In general, a guide channel 151*a*, 161*a* is formed on a lateral side of the receiving hole 15*a*, 16*a* in communication therewith. The guide channel 151*a*, 161*a* extends in a direction to the locking hole 411*a*, 421*a*. In addition, the gasket member 61*a*, 62*a* has a guide bar 611*a*, 621*a* extending from the edge of the gasket member 61*a*, 62*a* toward the locking hole 411*a*, 421*a*. The guide bar 611*a*, 621*a* is slidably disposed in the guide channel 151*a*, 161*a*. Accordingly, the guide channel 151*a*, 161*a* can guide the guide bar 611*a*, 621*a* of the gasket member 61*a*, 62*a* fitted on the screw 51*a*, 52*a* to aim the screws 51*a*, 52*a* at the locking hole 411*a*, 421*a*. However, such design has a shortcoming that the guide channel 151*a*, 161*a* and the guide bar 611*a*, 621*a* both extend in the direction to the electro-conductive member 3*a* and the contact sections 412*a*, 422*a* of the first and second contact terminals 41*a*, 42*a*. The guide channel 151*a*, 161*a* and the guide bar 611*a*, 621*a* are so close to the electro-conductive member 3*a* and the contact sections 412*a*, 422*a* of the first and second contact terminals 41*a*, 42*a* that the guide bar 611*a*, 621*a* tends to interfere with the electro-conductive member 3*a* and the contact sections 412*a*, 422*a* of the first and second contact terminals 41*a*, 42*a*. For avoiding the interference, it is necessary to increase the height of the casing 1*a*. This leads to increase of the volume of the casing 1*a* and is not beneficial to miniaturization of the casing 1*a*.

Furthermore, after the screws 51*a*, 52*a* are unscrewed from the locking holes 411*a*, 421*a*, the screws 51*a*, 52*a* are possibly not detached from the locking holes 411*a*, 421*a*. Especially when the pushbutton 2*a* of the casing 1*a* is directed downward and the receiving holes 15*a*, 16*a* are open to upper side, the screws 51*a*, 52*a* can be hardly moved away from the locking holes 411*a*, 421*a* under affection of gravity. Under such circumstance, the tail ends of the screws 51*a*, 52*a* cannot be spaced from the corresponding locking holes 411*a*, 421*a* to keep the gap H. As a result, the closed wire terminals 91*a*, 92*a* cannot extend between the screws 51*a*, 52*a* and the first and second contact terminals 41*a*, 42*a*. To solve this problem, a further improved switch wire-connection terminal block employs a spring to drive the screws 51*a*, 52*a* to normally move away from the locking holes 411*a*, 421*a* when unscrewed. For example, a spring 70*a* is disposed in the guide channel 151*a* to drive the guide bar 611*a* and the gasket member 61*a* to move the screw 51*a* in a direction away from the locking hole 411*a*. However, such design still has a shortcoming that in order to avoid interference between the guide channel 151*a*, the spring 70*a* and the guide bar 611*a* and the electro-conductive member 3*a* and the contact sections 412*a*, 422*a* of the first and second contact terminals 41*a*, 42*a*, it is also necessary to increase the volume of the casing 1*a*. This is not beneficial to miniaturization of the casing 1*a*.

SUMMARY OF THE INVENTION

It is therefore a primary object of the present invention to provide a switch wire-connection terminal block structure. In the condition that the total volume of the terminal block is not increased, the switch wire-connection terminal block structure provides a longer locking travel between the locking members and the locking holes. Accordingly, the switch wire-connection terminal block structure is applicable to various wire terminals including closed wire terminals to eliminate the above shortcomings existing in the conventional switch wire-connection terminal block structures.

To achieve the above and other objects, the switch wire-connection terminal block structure of the present invention includes a casing. At least one contact terminal is disposed in the casing. The contact terminal has a locking hole. The locking hole is positioned at one end of a receiving hole in the casing. The receiving hole intersects and communicates with a wire socket formed in the casing. A locking member is disposed in the receiving hole for locking into the locking hole. A gasket member is fitted on the locking member. At least one guide channel is formed on inner wall of the receiving hole. The guide channel extends in a direction reverse to a direction in which the locking member is locked into the locking hole. At least one guide section is formed on the gasket member. The guide section extends in the direction reverse to the direction in which the locking member is locked into the locking hole. The guide section is slidably disposed in the guide channel.

In the above switch wire-connection terminal block structure, the gasket member has at least one push section. The push section extends from the gasket member in a radial direction of the receiving hole away from the receiving hole. An elastic member is disposed beside the receiving hole for driving the push section in the direction reverse to the direction in which the locking member is locked into the locking hole.

In the above switch wire-connection terminal block structure, a pushbutton is movably disposed on the casing. The pushbutton extends from outer side into the casing. An electro-conductive member is disposed in the casing and connected with the pushbutton. Two ends of the contact terminal respectively have the locking hole and a contact section corresponding to the electro-conductive member. The electro-conductive member is drivable by the pushbutton to separably contact the contact section. The locking member can be a screw and the elastic member can be a spring.

In use, the locking member is first unscrewed and loosened from the locking hole. Under such circumstance, the locking member can be driven by the elastic member along with the push section of the gasket member to move in the direction reverse to the direction in which the locking member is locked into the locking hole. In addition, the locking member is guided by the guide channel of the inner wall of the receiving hole along with the guide section of the gasket member to move in the direction reverse to the direction in which the locking member is locked into the locking hole. Accordingly, the locking member is unscrewed out of the locking hole to define a gap between the locking member and the contact terminal. Then, any variety of external wire terminal connected with a wire can be extended from the wire socket into the receiving hole, whereby the wire terminal is extended into the gap between the locking member and the contact terminal. Then the locking member is locked back into the locking hole, whereby the locking member is framed by the wire terminal. Under such circumstance, the wire terminal is electrically connected to the contact terminal via the locking member. In this case, by means of pressing the pushbutton, the electro-conductive member is driven by the pushbutton to contact or separate from the contact section so as to power on or power off the contact terminal.

The guide section of the gasket member extends in the direction reverse to the direction in which the locking member is locked into the locking hole. In addition, the push section of the gasket member extends from the gasket member in the radial direction of the receiving hole. Accordingly, the travel of the guide section for guiding the screw to ascend coincides with the original inevitable path of the screw head. This totally eliminates the problem of the conventional switch wire-connection terminal block that in the condition that the total volume of the terminal block is not increased, the guide bar of the screw and the spring and the contact terminal may interfere with each other. Therefore, the total size of the product can keep miniaturized.

In the above switch wire-connection terminal block structure, the casing has a front end, a rear end opposite to the front end and two lateral ends positioned on two sides of the front and rear ends. The pushbutton is disposed at the front end of the casing. A first contact terminal and a second contact terminal are positioned on two sides of the pushbutton. The electro-conductive member is positioned between the first and second contact terminals. The receiving hole communicates with the rear end of the casing. The wire socket communicates with the lateral ends. The guide channel is formed on the inner wall of the receiving hole. The guide section is disposed on a lateral edge of the gasket member corresponding to the guide channel. Accordingly, via the guide sections, the gasket member is guided by the guide channels of the inner wall of two sides of the receiving hole to make the locking member stably move.

In the above switch wire-connection terminal block structure, the interior of the casing is partitioned by a spacer member to form a lateral cavity for receiving the elastic member. The lateral cavity communicates with the inner wall of the receiving hole via a travel channel. The travel channel extends in the direction in which the locking member is locked into the locking hole. The push section extends from the travel channel into the lateral cavity to be driven by the elastic member. The travel channel guides the push section to drive the gasket member to reciprocally move within the receiving hole along the path in which the locking member is locked into the locking hole. The spacer member is disposed between the contact section and the electro-conductive member and the elastic member. The elastic member is received in the lateral cavity to avoid interference between the electro-conductive member, the first and second contact terminals and the elastic members and the push sections. Also, the travel channel between the lateral cavity and the receiving hole serves to guide the push section of the gasket member, whereby the stability of move of the locking member is enhanced.

In the above switch wire-connection terminal block structure, a stop section is positioned between the receiving hole and the travel channel in the casing. The push section has a bent form to round the stop section into the travel channel. Accordingly, the elastic member in the lateral cavity can be disposed in a space out of the path in which any variety of wire terminal is inserted from the wire socket into the receiving hole. In this case, due to the interruption of the stop section and the disposition of the lateral cavity, when any variety of wire terminal is extended into the receiving hole, the wire terminal will not intersect or interfere with the extension/compression path of the elastic member. Therefore, the smoothness and reliability of the extension/compression operation of the elastic member are enhanced.

In the above switch wire-connection terminal block structure, the push paths of the contact section and the electro-conductive member are both not aligned with the position where the elastic member is positioned. Accordingly, the space utilized by the push paths of the contact section and the electro-conductive member is non-coincident with the disposition space of the elastic member to make the most of space and minimize the volume.

In the above switch wire-connection terminal block structure, the push section and guide section of the gasket member are both positioned beside a screw head of the screw. Therefore, even though the screw fitted with the gasket member is processed to form the thread, the screw is still free from the interference of the push section and the guide section of the gasket member. Therefore, the screw can be processed to form the thread in the condition that the gasket member is connected with the screw. In this case, the processing procedure can be performed at the same time to save the troublesome manufacturing process that the gasket member is screwed onto the screw after the thread is formed. Therefore, the manufacturing efficiency is effectively enhanced.

The present invention can be best understood through the following description and accompanying drawings, wherein:

DETAILED DESCRIPTION OF THE PREFERRED EMBODIMENTS

Figure 1:
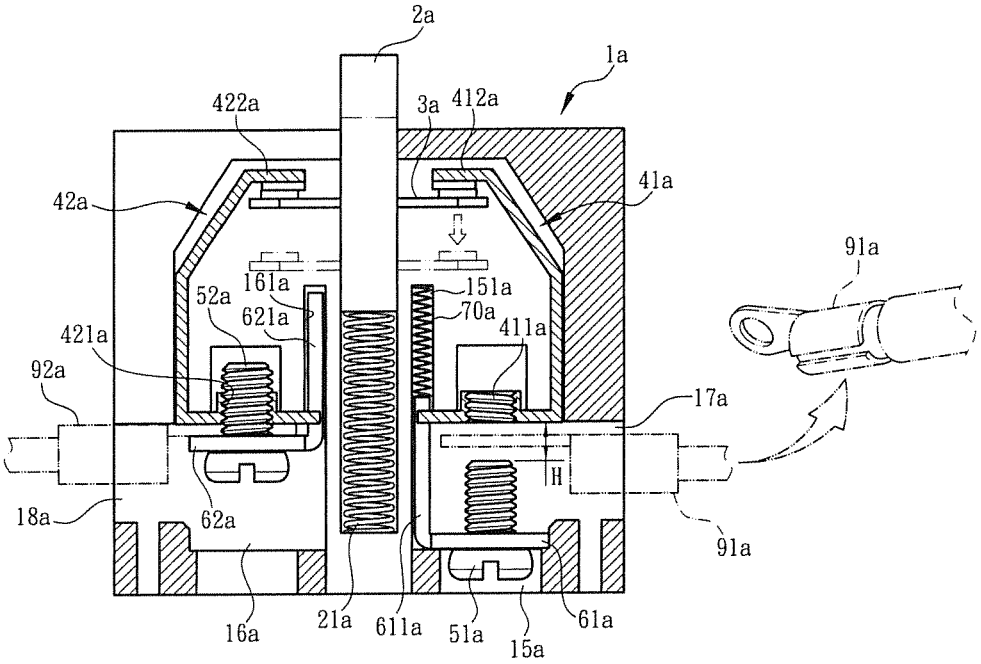
Fig. 1 PRIOR ART
FIG. 1 is a sectional view of a conventional switch wire-connection terminal block.
Figure 2:
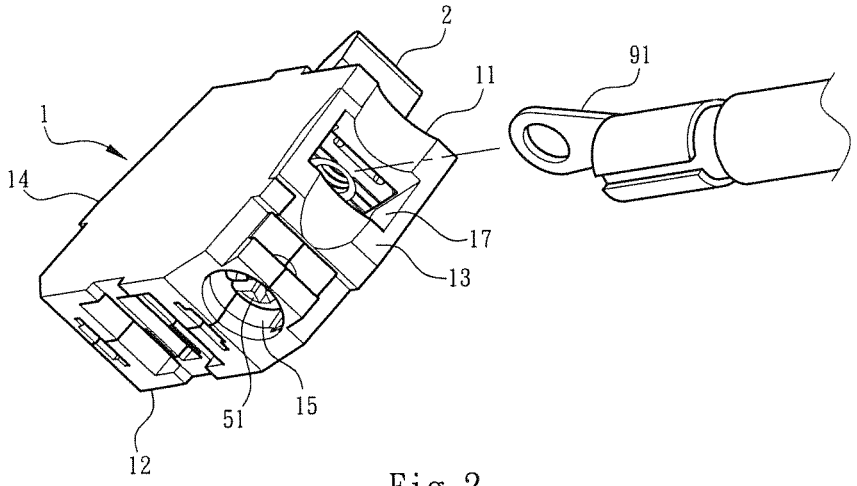
FIG. 2 is a perspective assembled view of the switch wire-connection terminal block structure of the present invention, showing that a closed wire terminal is to be inserted into the terminal block.
Figure 3:
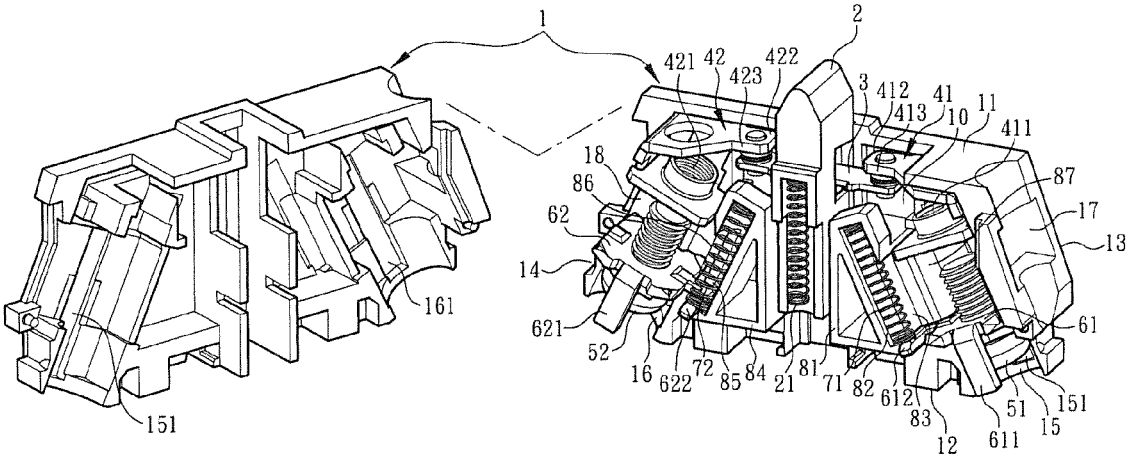
FIG. 3 is a perspective exploded view of the switch wire-connection terminal block structure of the present invention according to FIG. 2.
Figure 4:
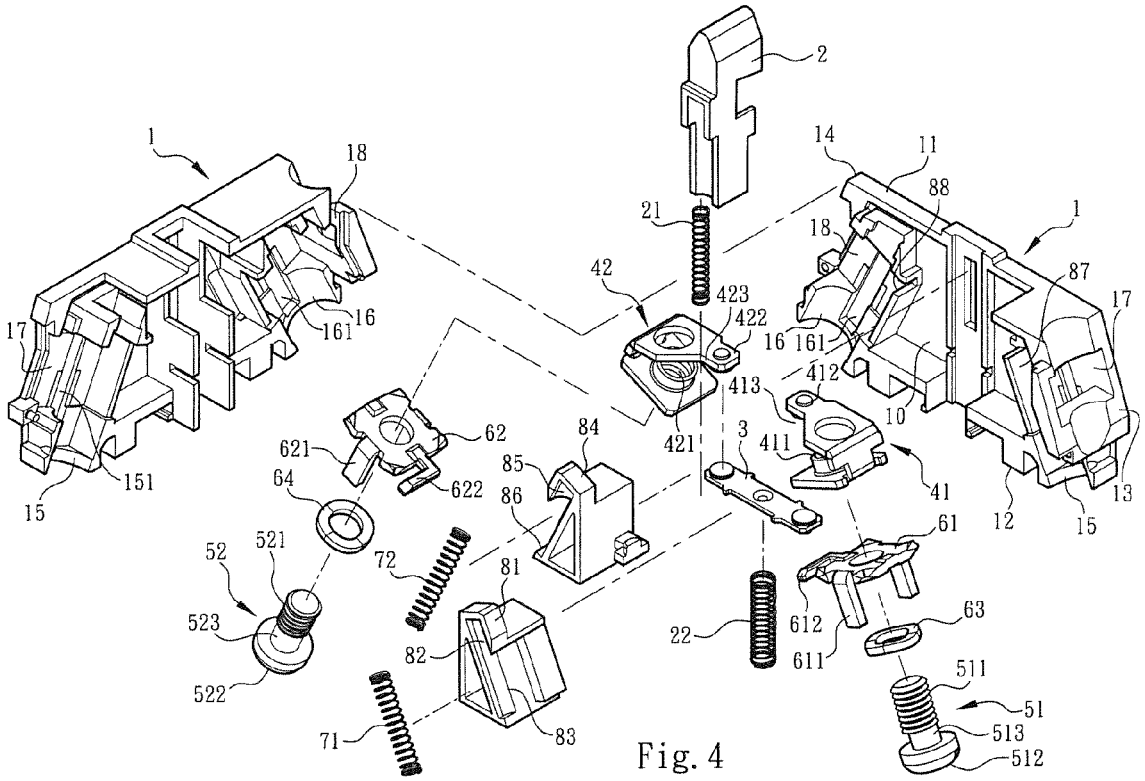
FIG. 4 is a perspective exploded view of the switch wire-connection terminal block structure of the present invention according to FIG. 3.

Please refer to FIGS. 2, 3 and 4. According to the drawings, the switch wire-connection terminal block structure of the present invention includes a casing 1 having a front end 11, a rear end 12 opposite to the front end 11 and two lateral ends 13, 14 positioned on two sides of the front and rear ends 11, 12. The casing 1 has an internal chamber 10. A pushbutton 2 is movably disposed at the front end 11 of the casing 1. The pushbutton 2 extends from outer side into the chamber 10 to bear the elastic force of at least one spring 21, 22. At least one contact terminal and an electro-conductive member 3 connected with the pushbutton 2 are disposed in the casing 1. Each of two ends of the contact terminal has a locking hole 411, 421 and a contact section 412, 422 corresponding to the electro-conductive member 3. The locking hole 411, 421 is positioned at one end of a receiving hole formed in the casing 1. The receiving hole intersects and communicates with a wire socket formed in the casing 1. To speak more specifically, a first contact terminal 41 and a second contact terminal 42 are disposed in the casing 1 and positioned on two sides of the pushbutton 2. The numbers of the receiving holes and the wire sockets are equal to the number of the contact terminals. There are a first receiving hole 15 and a second receiving hole 16 in communication with the rear end 12 of the casing 1. There are a first wire socket 17 and a second wire socket 18 respectively in communication with the two lateral ends 13, 14 of the casing 1. The first receiving hole 15 in the chamber 10 intersects and communicates with the first wire socket 17, while the second receiving hole 16 in the chamber 10 intersects and communicates with the second wire socket 18.

Figure 7:
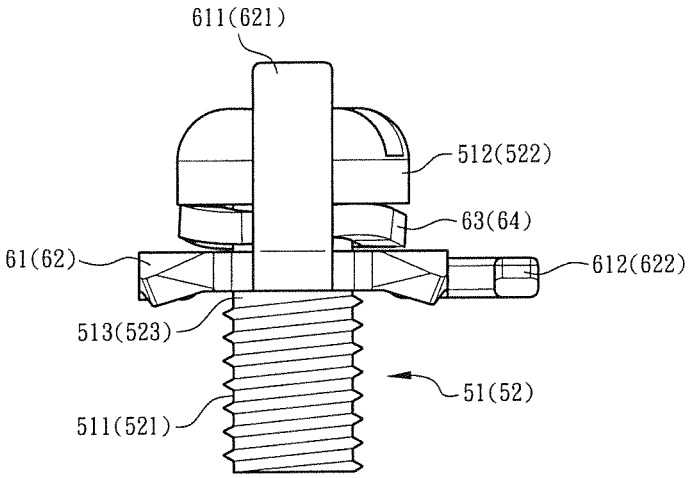
FIG. 7 is a view showing the arrangement of the locking member and the gasket member of the present invention according to FIG. 3.

As shown in the drawings, the electro-conductive member 3 is positioned between the first contact terminal 41 and the second contact terminal 42. The electro-conductive member 3 is drivable by the pushbutton 2 to separably contact the contact sections 412, 422 of the first and second contact terminals 41, 42 so as to power on or power off the first and second contact terminals 41, 42. A first locking member 51 is arranged in the first receiving hole 15. The first locking member 51 is lockable in the locking hole 411 of the first contact terminal 41. A first gasket member 61 is fitted on the first locking member 51. A second locking member 52 is arranged in the second receiving hole 16. The second locking member 52 is lockable in the locking hole 421 of the second contact terminal 42. A second gasket member 62 is fitted on the second locking member 52. In this embodiment, the first and second locking members 51, 52 are screws. The first wire socket 17 is in straight communication with the thread 511 of the screw in the first receiving hole 15. The second wire socket 18 is in straight communication with the thread 521 of the screw in the second receiving hole 16. The first gasket member 61 and a spring washer 63 are fitted in an annular groove 513 between the thread 511 and the screw head 512 of the first locking member 51 (screw). The spring washer 63 is positioned between the first gasket member 61 and the screw head 512 (with reference to FIG. 7). The second gasket member 62 and a spring washer 64 are fitted in an annular groove 523 between the thread 521 and the screw head 522 of the second locking member 52 (screw). The spring washer 64 is positioned between the second gasket member 62 and the screw head 522.

Figure 5:
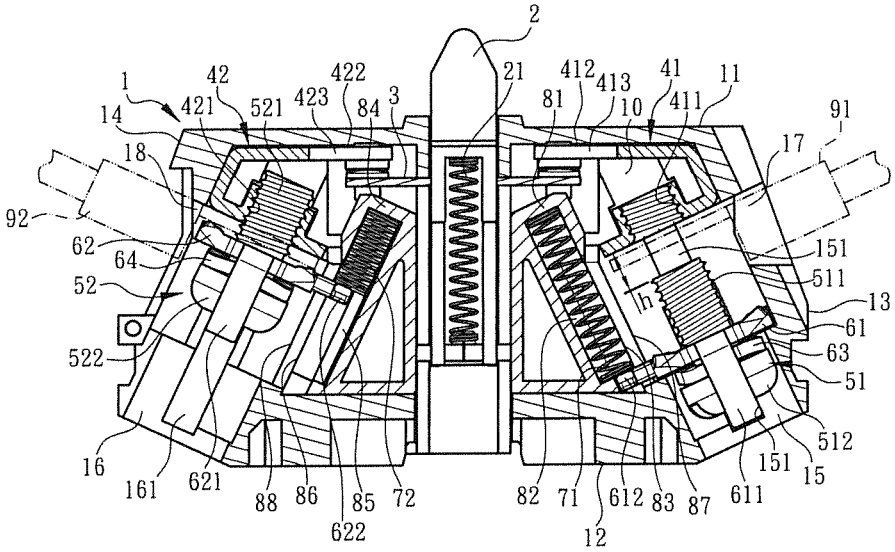
FIG. 5 is a sectional view of the switch wire-connection terminal block structure of the present invention according to FIG. 2.

Please now refer to FIG. 5. In this embodiment, at least one guide channel 151 is formed on inner wall of the first receiving hole 15. The guide channel 151 of the first receiving hole 15 extends in a direction reverse to a direction in which the first locking member 51 is locked into the locking hole 411. At least one guide channel 161 is formed on inner wall of the second receiving hole 16. The guide channel 161 of the second receiving hole 16 extends in a direction reverse to a direction in which the second locking member 52 is locked into the locking hole 421. At least one guide section 611 is formed on an edge of the first gasket member 61. The guide section 611 of the first gasket member 61 extends in a direction reverse to a direction in which the first locking member 51 is locked into the locking hole 411 in the form of a bar. The guide section 611 of the first gasket member 61 is slidably disposed in the guide channel 151 of the first receiving hole 15. In addition, a push section 612 extends from the edge of the first gasket member 61 in a radial direction of the first receiving hole 15 away from the first receiving hole 15. At least one guide section 621 is formed on an edge of the second gasket member 62. The guide section 621 of the second gasket member 62 extends in a direction reverse to a direction in which the second locking member 52 is locked into the locking hole 421 in the form of a bar. The guide section 621 of the second gasket member 62 is slidably disposed in the guide channel 161 of the second receiving hole 16. In addition, a push section 622 extends from the edge of the second gasket member 62 in a radial direction of the second receiving hole 16 away from the second receiving hole 16. The push sections 612, 622 and the guide sections 611, 621 of the first and second gasket members 61, 62 are all positioned beside the screw heads 512, 522 of the screws.

In this embodiment, two guide channels 151 are symmetrically formed on two inner sidewalls of the first receiving hole 15. The first gasket member 61 has two symmetrical guide sections 611 formed on two lateral edges of the first gasket member 61 corresponding to the guide channels 151. Two guide channels 161 are symmetrically formed on two inner sidewalls of the second receiving hole 16. The second gasket member 62 has two symmetrical guide sections 621 formed on two lateral edges of the second gasket member 62 corresponding to the guide channels 161. Under such circumstance, the guide sections 611, 621 on two sides of the first and second gasket members 61, 62 are guided by the guide channels 151, 161 formed on the two inner sidewalls of the first and second receiving holes 15, 16, whereby the first and second locking members 51, 52 can be stably moved. A first elastic member 71 is disposed beside the first receiving hole 15. The first elastic member 71 can drive the push section 612 of the first gasket member 61 in a direction reverse to the direction in which the first locking member 51 is locked into the locking hole 411. A second elastic member 72 is disposed beside the second receiving hole 16. The second elastic member 72 can drive the push section 622 of the second gasket member 62 in a direction reverse to the direction in which the second locking member 52 is locked into the locking hole 421. The first and second elastic members 71, 72 can be springs.

As shown in FIGS. 3, 4 and 5, a first spacer member 81 is disposed between the electro-conductive member 3, the contact section 412 of the first contact terminal 41 and the first elastic member 71. The first spacer member 81 defines a first lateral cavity 82 in the chamber 10 for receiving the first elastic member 71. The first lateral cavity 82 communicates with the inner wall of the first receiving hole 15 via a first travel channel 83. The first travel channel 83 extends in the direction in which the first locking member 51 is locked into the locking hole 411. The push section 612 of the first gasket member 61 extends through the first travel channel 83 into the first lateral cavity 82 to be driven by the first elastic member 71. In addition, the first travel channel 83 serves to guide the push section 612 of the first gasket member 61 and drive the first gasket member 61 to reciprocally move within the first receiving hole 15 along the path in which the first locking member 51 is locked into the locking hole 411. A second spacer member 84 is disposed between the electro-conductive member 3, the contact section 422 of the second contact terminal 42 and the second elastic member 72. The second spacer member 84 defines a second lateral cavity 85 in the chamber 10 for receiving the second elastic member 72. The second lateral cavity 85 communicates with the inner wall of the second receiving hole 16 via a second travel channel 86. The second travel channel 86 extends in the direction in which the second locking member 52 is locked into the locking hole 421. The push section 622 of the second gasket member 62 extends through the second travel channel 86 into the second lateral cavity 85 to be driven by the second elastic member 72. In addition, the second travel channel 86 serves to guide the push section 622 of the second gasket member 62 and drive the second gasket member 62 to reciprocally move within the second receiving hole 16 along the path in which the second locking member 52 is locked into the locking hole 421.

The first spacer member 81 is further formed with an extending first stop section 87 positioned in one side of the chamber 10 of the casing 1. The first stop section 87 is positioned between the first receiving hole 15 and the first travel channel 83. The wire plugging path of the first wire socket 17 is interrupted by the first stop section 87 from directly going to the first travel channel 83. The second spacer member 84 is further formed with an extending second stop section 88 positioned in another side of the chamber 10 of the casing 1. The second stop section 88 is positioned between the second receiving hole 16 and the second travel channel 86. The wire plugging path of the second wire socket 18 is interrupted by the second stop section 88 from directly going to the second travel channel 86. The push section 612 of the first gasket member 61 is bent in an L-shaped form to round the first stop section 87 into the first travel channel 83. Accordingly, the push section 612 of the first gasket member 61 and the first elastic member 71 in the first lateral cavity 82 can be disposed in a space out of the path in which the wire terminal is inserted from the first wire socket 17 into the first receiving hole 15. The push section 622 of the second gasket member 62 is bent in an L-shaped form to round the second stop section 88 into the second travel channel 86. Accordingly, the push section 622 of the second gasket member 62 and the second elastic member 72 in the second lateral cavity 85 can be disposed in a space out of the path in which the wire terminal is inserted from the second wire socket 18 into the second receiving hole 16. In this case, the insertion of the wire terminals will not affect or interfere with the operation of the first and second elastic members 71, 72.

Figure 6:
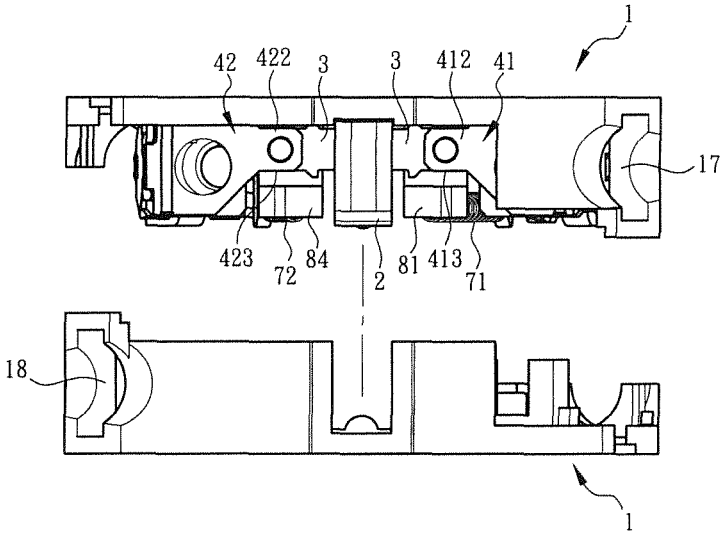
FIG. 6 is a top exploded view of the switch wire-connection terminal block structure of the present invention according to FIG. 2.

Please refer to FIG. 6. The push paths of the contact sections 412, 422 and the electro-conductive member 3 are all not aligned with the positions where the first and second elastic members 71, 72 are positioned. Accordingly, the space utilized by the push paths of the contact sections 412, 422 and the electro-conductive member 3 is non-coincident with the disposition space of the first and second elastic members 71, 72 to make the most of space and minimize the volume. In a preferred embodiment, the contact section 412 of the first contact terminal 41 is formed with a notch 413 corresponding to the first elastic member 71, whereby one end of the electro-conductive member 3 and the contact section 412 of the first contact terminal 41 are both not aligned with the first elastic member 71. The contact section 422 of the second contact terminal 42 is formed with a notch 423 corresponding to the second elastic member 72, whereby the other end of the electro-conductive member 3 and the contact section 422 of the second contact terminal 42 are both not aligned with the second elastic member 72.

In use, the first and second locking members 51, 52 are first unscrewed and loosened from the locking holes 411, 421. Under such circumstance, the first locking member 51 can be driven by the first elastic member 71 along with the push section 612 of the first gasket member 61 to move in the direction reverse to the direction in which the first locking member 51 is locked into the locking hole 411. In addition, the first locking member 51 is guided by the guide channel 151 of the inner wall of the first receiving hole 15 along with the guide section 611 of the first gasket member 61 to move in the direction reverse to the direction in which the first locking member 51 is locked into the locking hole 411. Accordingly, the first locking member 51 is unscrewed out of the locking hole 411 to define a gap h between the first locking member 51 and the first contact terminal 41 (as shown in FIG. 5). Also, the second locking member 52 is driven by the second elastic member 72 along with the push section 622 of the second gasket member 62 to move in the direction reverse to the direction in which the second locking member 52 is locked into the locking hole 421. In addition, the second locking member 52 is guided by the guide channel 161 of the inner wall of the second receiving hole 16 along with the guide section 621 of the second gasket member 62 to move in the direction reverse to the direction in which the second locking member 52 is locked into the locking hole 421. Accordingly, the second locking member 52 is unscrewed out of the locking hole 421 to define a gap (equal to the gap h) between the second locking member 52 and the second contact terminal 42.

Then, any variety of external wire terminals connected with wires can be extended into the first and second wire sockets 17, 18. For example, an external first closed wire terminal 91 is extended from the first wire socket 17 into the first receiving hole 15, whereby the first closed wire terminal 91 is extended into the gap h between the first locking member 51 and the first contact terminal 41. Then the first locking member 51 is locked back into the locking hole 411 of the first contact terminal 41, whereby the first locking member 51 is framed by the first closed wire terminal 91. Under such circumstance, the first closed wire terminal 91 is electrically connected to the first contact terminal 41 via the first locking member 51. Then, an external second closed wire terminal 92 is extended from the second wire socket 18 into the second receiving hole 16, whereby the second closed wire terminal 92 is extended into the gap between the second locking member 52 and the second contact terminal 42. Then the second locking member 52 is locked back into the locking hole 421 of the second contact terminal 42, whereby the second locking member 52 is framed by the second closed wire terminal 92. Under such circumstance, the second closed wire terminal 92 is electrically connected to the second contact terminal 42 via the second locking member 52. In this case, by means of pressing the pushbutton 2, two ends of the electro-conductive member 3 are driven by the pushbutton 2 to contact or separate from the contact sections 412, 422 of the first and second contact terminals 41, 42 so as to power on or power off the first and second contact terminals 41, 42.

It should be noted that the guide sections 611, 621 of the first and second gasket members 61, 62 extend in the direction reverse to the direction in which the first and second locking members 51, 52 are locked into the locking holes 411, 421. In addition, the push sections 612, 622 of the first and second gasket members 61, 62 extend from the first and second gasket members 61, 62 in the radial direction of the first and second receiving holes 15, 16. Accordingly, the travel of the guide sections 611, 621 for guiding the screws (the first and second locking members 51, 52) to ascend coincides with the original inevitable path of the screw heads 512, 522. This totally eliminates the problem of the conventional switch wire-connection terminal block that in the condition that the total volume of the terminal block is not increased, the guide bars of the screws and the springs and the contact terminals may interfere with each other. The present invention is applicable to the closed wire terminals to connect the wires. Moreover, the total size of the product can keep miniaturized.

It should be noted that the first and second elastic members 71, 72 are received in the first and second lateral cavities 82, 85 to avoid interference between the electro-conductive member 3, the first and second contact terminals 41, 42, the first and second elastic members 71, 72 and the push sections 612, 622. Also, the first and second travel channels 83, 86 between the first and second lateral cavities 82, 85 and the first and second receiving holes 15, 16 serve to guide the push sections 612, 622 of the first and second gasket members 61, 62, whereby the stability of move of the first and second locking members 51, 52 can be further enhanced. Moreover, due to the interruption of the first and second stop sections 87, 88 and the disposition of the first and second lateral cavities 82, 85, when various wire terminals are extended into the first and second receiving holes 15, 16, the wire terminals will not intersect and interfere with the extension/compression paths of the first and second elastic members 71, 72. Therefore, the smoothness and reliability of the extension/compression operation of the first and second elastic members 71, 72 are enhanced.

Also, the contact sections 412, 422 of the first and second contact terminals 41, 42 are formed with the notches 413, 423 for providing a not aligned design in the chamber 10 to give a space on the other side for arranging the first and second elastic members 71, 72. Accordingly, the disposition space of the contact sections 412, 422 of the first and second contact terminals 41, 42 and the electro-conductive member 3 coincides with the disposition space of the first and second elastic members 71, 72. Therefore, it is unnecessary to increase the height and width of the product. Furthermore, the first and second gasket members 61, 62 are disposed in the annular grooves 513, 523 between the threads 511, 521 and the screw heads 512, 522 of the screws. Therefore, even though the screws fitted with the first and second gasket members 61, 62 are processed to form the threads 511, 521, the screws are still free from the interference of the push sections 612, 622 and the guide sections 611, 621 of the first and second gasket members 61, 62. Therefore, the screws can be processed to form the threads 511, 521 in the condition that the first and second gasket members 61, 62 are connected with the screws. In this case, the processing procedure can be performed at the same time to save the troublesome manufacturing process that the first and second gasket members 61, 62 are screwed onto the screws after the threads are formed. Therefore, the manufacturing efficiency is effectively enhanced. The above embodiments are only used to illustrate the present invention, not intended to limit the scope thereof. Many modifications of the above embodiments can be made without departing from the spirit of the present invention.

What is claimed is:

1. A switch wire-connection terminal block structure comprising a casing, at least one contact terminal being disposed in the casing, the contact terminal having a locking hole, the locking hole being positioned at one end of a receiving hole in the casing, the receiving hole intersecting and communicating with a wire socket formed in the casing, a locking member being disposed in the receiving hole for locking into the locking hole, a gasket member being fitted on the locking member, at least one guide channel being formed on inner wall of the receiving hole, the guide channel extending in a direction reverse to a direction in which the locking member is locked into the locking hole, at least one guide section being formed on the gasket member, the guide section extending in the direction reverse to the direction in which the locking member is locked into the locking hole, the guide section being slidably disposed in the guide channel;

wherein the gasket member has at least one push section, the push section extending from the gasket member in a radial direction of the receiving hole away from the receiving hole, an elastic member being disposed beside the receiving hole for driving the push section in the direction reverse to the direction in which the locking member is locked into the locking hole.

2. The switch wire-connection terminal block structure as claimed in claim 1, wherein a pushbutton is movably disposed on the casing, the pushbutton extending from outer side into the casing, an electro-conductive member being disposed in the casing and connected with the pushbutton, two ends of the contact terminal respectively having the locking hole and a contact section corresponding to the electro-conductive member, the electro-conductive member being drivable by the pushbutton to separably contact the contact section.

3. The switch wire-connection terminal block structure as claimed in claim 1, wherein an interior of the casing is partitioned to form a lateral cavity for receiving the elastic member, the lateral cavity communicating with the inner wall of the receiving hole via a travel channel, the travel channel extending in the direction in which the locking member is locked into the locking hole, the push section extending from the travel channel into the lateral cavity to be driven by the elastic member, the travel channel guiding the push section to drive the gasket member to reciprocally move within the receiving hole along the path in which the locking member is locked into the locking hole.

4. The switch wire-connection terminal block structure as claimed in claim 3, wherein a stop section is disposed between the receiving hole and the travel channel in the casing, the push section having a bent form to round the stop section and extend into the travel channel.

5. The switch wire-connection terminal block structure as claimed in claim 3, wherein a pushbutton is movably disposed on the casing, the pushbutton extending from outer side into the casing, an electro-conductive member being disposed in the casing and connected with the pushbutton, two ends of the contact terminal respectively having the locking hole and a contact section corresponding to the electro-conductive member, the electro-conductive member being drivable by the pushbutton to separably contact the contact section, a spacer member is disposed between the contact section and the electro-conductive member and the elastic member, the spacer member defining the lateral cavity.

6. The switch wire-connection terminal block structure as claimed in claim 4, wherein a pushbutton is movably disposed on the casing, the pushbutton extending from outer side into the casing, an electro-conductive member being disposed in the casing and connected with the pushbutton, two ends of the contact terminal respectively having the locking hole and a contact section corresponding to the electro-conductive member, the electro-conductive member being drivable by the pushbutton to separably contact the contact section, a spacer member is disposed between the contact section and the electro-conductive member and the elastic member, the spacer member defining the lateral cavity.

7. The switch wire-connection terminal block structure as claimed in claim 1, wherein the guide channel is formed on the inner wall of the receiving hole, the guide section being disposed on a lateral edge of the gasket member corresponding to the guide channel.

8. The switch wire-connection terminal block structure as claimed in claim 3, wherein the guide channel is formed on the inner wall of the receiving hole, the guide section being disposed on a lateral edge of the gasket member corresponding to the guide channel.

9. The switch wire-connection terminal block structure as claimed in claim 4, wherein the guide channel is formed on the inner wall of the receiving hole, the guide section being disposed on a lateral edge of the gasket member corresponding to the guide channel.

10. The switch wire-connection terminal block structure as claimed in claim 5, wherein the guide channel is formed on the inner wall of the receiving hole, the guide section being disposed on a lateral edge of the gasket member corresponding to the guide channel.

11. The switch wire-connection terminal block structure as claimed in claim 2, wherein push paths of the contact section and the electro-conductive member are both not aligned with the position where the elastic member is positioned.

12. The switch wire-connection terminal block structure as claimed in claim 10, wherein push paths of the contact section and the electro-conductive member are both not aligned with the position where the elastic member is positioned.

13. The switch wire-connection terminal block structure as claimed in claim 2, wherein the casing has a front end, a rear end opposite to the front end and two lateral ends positioned on two sides of the front and rear ends, the pushbutton being disposed at the front end of the casing, a first contact terminal and a second contact terminal being positioned on two sides of the pushbutton, the electro-conductive member being positioned between the first and second contact terminals, the receiving hole communicating with the rear end of the casing, the wire socket communicating with the lateral ends.

14. The switch wire-connection terminal block structure as claimed in claim 10, wherein the casing has a front end, a rear end opposite to the front end and two lateral ends positioned on two sides of the front and rear ends, the pushbutton being disposed at the front end of the casing, a first contact terminal and a second contact terminal being positioned on two sides of the pushbutton, the electro-conductive member being positioned between the first and second contact terminals, the receiving hole communicating with the rear end of the casing, the wire socket communicating with the lateral ends.

15. The switch wire-connection terminal block structure as claimed in claim 1, wherein the locking member is a screw and the elastic member is a spring, the push section and guide section of the gasket member being both positioned beside a screw head of the screw.

16. The switch wire-connection terminal block structure as claimed in claim 7, wherein the locking member is a screw and the elastic member is a spring, the push section and guide section of the gasket member being both positioned beside a screw head of the screw.

* * * * *